US009328709B2

(12) United States Patent
Higashiyama

(10) Patent No.: US 9,328,709 B2
(45) Date of Patent: May 3, 2016

(54) FUEL SUPPLY STRUCTURE OF SADDLE-RIDE TYPE VEHICLE

(71) Applicant: HONDA MOTOR CO., LTD., Tokyo (JP)

(72) Inventor: Junji Higashiyama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 349 days.

(21) Appl. No.: 13/847,365

(22) Filed: Mar. 19, 2013

(65) Prior Publication Data

US 2013/0247872 A1 Sep. 26, 2013

(30) Foreign Application Priority Data

Mar. 21, 2012 (JP) ..... 2012-064078

(51) Int. Cl.

| | |
|---|---|
| ***F02M 69/04*** | (2006.01) |
| ***F02M 69/00*** | (2006.01) |
| ***F02M 37/00*** | (2006.01) |
| *F02D 9/00* | (2006.01) |
| *F02D 1/00* | (2006.01) |
| *F02M 59/00* | (2006.01) |

(52) U.S. Cl.

CPC ..... *F02M 69/00* (2013.01); *F02M 37/0017* (2013.01); *F02D 1/00* (2013.01); *F02D 9/00* (2013.01); *F02M 59/00* (2013.01); *F02M 69/044* (2013.01); *F02M 2700/1317* (2013.01)

(58) Field of Classification Search

CPC ..... F02M 69/044; F02M 59/00; F02M 2700/1317; F02D 1/00; F02D 9/00

USPC ..... 123/445

See application file for complete search history.

(56) References Cited

U.S. PATENT DOCUMENTS

2005/0109321 A1 * 5/2005 Ikeda et al. ..... 123/432

FOREIGN PATENT DOCUMENTS

| | | |
|---|---|---|
| JP | 2000-9279 A | 1/2000 |
| JP | 2007-177682 A | 7/2007 |

* cited by examiner

*Primary Examiner* — Lindsay Low
*Assistant Examiner* — Charles Brauch
(74) *Attorney, Agent, or Firm* — Birch, Stewart, Kolasch & Birch, LLP

(57) ABSTRACT

A fuel supply structure of a saddle-ride type vehicle wherein a wrong operation of a hose locking member is more securely prevented during maintenance of the vehicle to enhance the maintainability without increasing the number of parts. Fuel supplied from a fuel tank to a throttle body is supplied via fuel supply parts through a flexible fuel hose. A cover member for covering the fuel supply parts is provided. The cover member is provided with a cover that covers a fuel hose locking member for locking the connection of the fuel hose and each fuel supply part. In addition, the cover covers the fuel hose locking member to disenable removing the fuel hose locking member.

14 Claims, 9 Drawing Sheets

FUEL SUPPLY STRUCTURE OF SADDLE-RIDE TYPE VEHICLE

CROSS-REFERENCE TO RELATED APPLICATIONS

The present application claims priority under 35 USC 119 to Japanese Patent Application No. 2012-064078 filed Mar. 21, 2012 the entire contents of which are hereby incorporated by reference.

BACKGROUND OF THE INVENTION

1. Field of the Invention

The present invention relates to fuel supply structure of an internal combustion engine. More particularly, to a fuel supply structure of a saddle-ride type vehicle.

2. Description of Background Art

A conventional fuel supply wherein an electronic controlled fuel injection system is adopted when fuel is supplied from a fuel tank to a throttle body includes a fuel pump, a fuel filter, a regulator and other elements wherein fuel supply parts are connected via a fuel hose. The fuel supply part has a structure wherein a rubber or synthetic resin flexible fuel hose is connected to a joint of the fuel supply part and is locked by a clamp and is fixed by a hose fastening member such as a detachable fitting joint by the fitting of combination members. See, for example, JP-A No. 2000-9279.

In addition, in a saddle-ride type vehicle, an engine and its peripheral parts are exposed. Therefore, some saddle-ride type vehicles have a structure wherein a protective cover that covers a fuel injection valve, fuel hose and a throttle body are provided. See, for example, JP-A No. 2007-177682.

In a saddle-ride type vehicle, when a hose fastening member is removed for maintenance of a fuel supply part or its peripheral location, a measure to prevent fuel that remains in a fuel hose from being scattered around is required.

For example, as for a protective cover disclosed in JP-A No. 2000-9279, as the protective cover covers each hose fastening member, the protective covers are required by the number of hose fastening members and the number of parts increases. In addition, as the operation for attaching/detaching the protective cover is also required to be performed by the number of the hose fastening members, the protective cover also has a problem in workability.

As for the protective cover disclosed in JP-A No. 2007-177682, the protective cover does not cover a joint of the fuel hose and the fuel injection valve. Thus, during maintenance of the throttle body and its peripheral parts, the above-mentioned measure is required.

SUMMARY AND OBJECTS OF THE INVENTION

The present invention is made in view of the above-mentioned situation and an object of an embodiment of the present invention is to provide a fuel supply structure of a saddle-ride type vehicle, which can contribute to, in the maintenance of a fuel supply part or its peripheral location, prevention of the unnecessary detachment of a hose fastening member, prevention of an increase in the number of parts and also enhancement in the maintainability.

According to an embodiment of the present invention, a fuel supply structure of a saddle-ride type vehicle wherein fuel supplied from a fuel tank to a fuel injection valve is supplied via a fuel supply part through a flexible fuel hose including:

a cover member for covering the fuel supply part, and the cover member is provided with a cover that covers a fuel hose locking member for locking the connection of the fuel hose and the fuel supply part.

According to an embodiment of the present invention, the cover member is attached/detached to/from a body frame in a state wherein the cover member covers the fuel hose locking member.

According to an embodiment of the present invention, the cover member includes a assembly structure formed of a case and a lid. The case and the lid have recessed portions corresponding to an exterior shape of the fuel supply parts wherein the cover member covers the fuel supply parts and the fuel hose locking members is maintained by the fitting of a plurality of fitting parts formed in both.

According to an embodiment of the present invention, an elastic cushion member abutting on the fuel supply part is provided to the cover member.

According to an embodiment of the present invention, the fuel supply parts are a fuel filter and a regulator. The cover member integrally covers the fuel filter and the regulator.

According to an embodiment of the present invention, as the fuel hose locking member is covered so that the hose locking member cannot be removed in a state wherein the cover member is attached to a vehicle body, the operation for removing the fuel hose locking member can be avoided and the adhesion of fuel in work can be prevented.

According to an embodiment of the present invention, as the cover member is removed from the vehicle body in a state wherein the cover member covers the fuel hose locking member of the fuel supply part, the fuel hose cannot be removed even in a state wherein the fuel supply part is removed from the vehicle body and the adhesion of fuel by a wrong operation can be avoided. In addition, the fuel supply part may be removed from the vehicle body and is covered with the cover member that can be moved with the flexible fuel hose connected. Thus, maintenance around the fuel supply part is easy.

According to an embodiment of the present invention, as the case and the lid of the cover member stably support the fuel supply parts, are securely locked by the fitting parts and are assembled, the fuel supply part is removable from the vehicle body in a covered state. Thus, the maintainability can be enhanced.

According to an embodiment of the present invention, as the cover member is provided with the elastic cushion member and the fuel supply part held with the fuel supply part resiliently pressed, the fuel supply part can be securely held without rattling in the case. In addition, the vibration of the vehicle body to the fuel supply part can be buffered.

According to an embodiment of the present invention, as the cover member covers the fuel filter and the regulator, a configuration can be provided wherein the fuel filter and the regulator are covered so that the fuel hose locking members for the plurality of parts of the fuel filter and the regulator cannot be removed. In addition, the fuel filter and the regulator are not required to be individually fixed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
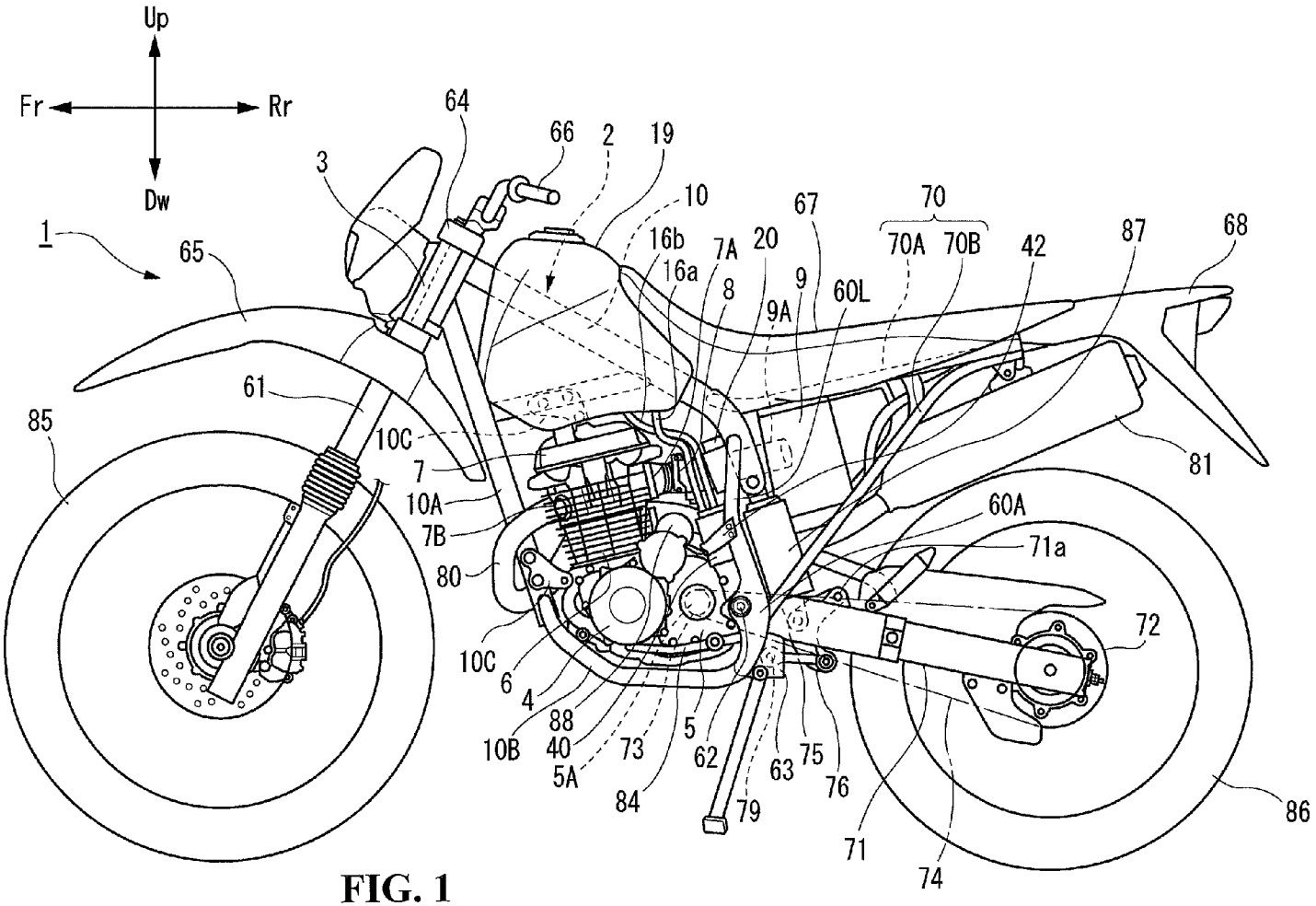
FIG. 1 is a left side view showing a motorcycle equivalent to one embodiment of the present invention.

One embodiment of the present invention will be described below.

Referring to the drawings, a motorcycle which is equivalent to this embodiment and which is suitable for use off road as one example of a saddle-ride type vehicle will be described below.

In the description of this embodiment, the description of a direction such as a longitudinal direction, a lateral direction and a vertical direction in this specification shall be a direction of a vehicle body of the motorcycle. In addition, the attached drawings shall be viewed in a direction of the reference signs in the drawings. In the drawings, Fr points to the front side of the vehicle body, Rr points to the rear side of the vehicle body, Up points to the upside of the vehicle body, Dw points to the downside of the vehicle body, R points to the right side of the vehicle body, and L points to the left side of the vehicle body.

In FIG. 1, to facilitate the description, a side cover and a shroud that respectively cover the outside of the vehicle body are suitably omitted.

As shown in FIG. 1, a body frame 2 of the motorcycle 1 is provided with one main frame 10 extending rearwardly and diagonally downwardly in the vehicle body from a head pipe 3 in the front of the vehicle body, a down tube 10A extends downwardly in the vehicle body from the head pipe 3 on the downside of the main frame 10, a pair of right and left lower pipes 10B for connecting with the downside of the down tube 10A extend rearwardly on the downside of the vehicle body with a pair of left and right center frames 60L, 60R (60L on the left side and 60R on the right side) that couple a rear end of the main frame 10 and respective rear ends of the lower pipes 10B. The body frame 2 configures a highly-rigid cradle type frame with an engine 4 suspended via engine hangers 10C and others on the inside enclosed by the body frame 2.

An upper pipe 70A and a lower pipe 70B that respectively configure a rear frame 70, extending rearwardly in the vehicle body, are attached to the main frame 10 and the center frames 60L, 60R. The rear frame 70 is configured by a pair of right and left upper pipes 70A extending rearwardly in the vehicle body from the rear of the main frame 10 and a pair of right and left lower pipes 70B extending rearwardly and diagonally upward in the vehicle body from lower parts of the center frames 60L, 60R with respective rear ends of the upper pipe 70A and the lower pipe 70B being coupled. In addition, a seat 67 is provided together with a rear fender 68 and a side cover not shown are attached to the upper pipe 70A and the lower pipe 70B.

A pair of right and left front forks 61 for journaling a front wheel 85 is provided to the downside of the head pipe 3. In addition, a top bridge 64 to which an operation handlebar 66 is fixed is coupled to the upside of the head pipe 3. In addition, a front fender 65 is attached to the downside of the head pipe 3 with the front fender covering the upside of the front wheel 85.

Each center frame 60L, 60R is provided with a curved part 60A on its downside and a pivot 62 that laterally pierces the vehicle body is provided to the curved part 60A. A front end of a swing arm 71 that journals a rear wheel 86 is vertically swingably supported by the pivot 62. In addition, a drive chain 74 is wound on a sprocket 72 provided to the rear wheel 86 and a sprocket 73 provided to an output shaft 5A of the engine 4 and the driving force of the engine 4 is transmitted to the rear wheel 86 via the drive chain 74.

In addition, a cross member 79 that laterally couples the center frames 60L, 60R is provided to the downside of the curved part 60A and a bracket 63 on the frame side is attached to the center in a direction of the width of the cross member 79. In the meantime, a supporting part 71*a* is provided to an upper part of the swing arm 71 and a link 76 is attached to the supporting part 71*a*. In addition, as for the link 76, for example, one end is attached to the supporting part 71*a*, with a base curved downwardly being attached to the downside of a rear shock absorber 87, and further, a lower end of the link 76 is attached to the bracket 63 on the frame side via a rod 75. Accordingly, the rod 75 suitably inhibits the motion in a turning direction of the link 76 with a connecting fulcrum of the link and the supporting part 71*a* of the swing arm 71 as a reference.

Further, a gear change pedal 84 for a rider to put his/her foot is provided in the vicinity of a lower part of the engine 4 (on the side of space between the engine 4 and the center frame 60) in front of the curved part 60A.

The engine 4 is provided with a crankcase 5 with a cylinder block 6 extending substantially upwardly from the front of the crankcase 5 and a cylinder head 7 coupled to an upper part of the cylinder block 6. In the cylinder block 6, a piston is reciprocatingly housed in a cylinder. In addition, a crankshaft coupled to the piston via a connecting rod and the output shaft 5A of the engine are journaled to the crankcase 5, and in the crankcase, a clutch mechanism, a shift mechanism and others that respectively configure a power transmission mechanism between the crankshaft and the output shaft 5A are housed. In addition, a starting motor 88 is arranged at the back of the engine 4 and on the front sides of the center frames 60L, 60R so as to enable rotating of the crankshaft by the starting motor 88.

In the cylinder head 7, an intake and exhaust valve that opens and closes an intake and exhaust passage that communicates with the cylinder in the cylinder block 6 is housed and an intake port 7A of the intake and exhaust passage is formed at the back of the cylinder head 7. A throttle body 8 is coupled to the intake port 7A and an air cleaner box 9 is coupled to the throttle body 8 via an intake pipe 9A.

An exhaust port 7B of the intake and exhaust passage is formed at the front of the cylinder head 7. An exhaust pipe 80 is connected to the exhaust port 7B. The exhaust pipe 80 extends forwardly from the exhaust port 7B, is curved on the right side of the cylinder head 7, and extends rearwardly in the vehicle. An exhaust muffler 81 is coupled to an extended end of the exhaust pipe.

A fuel tank 19 is arranged over the cylinder head 7 and in front of the seat 67. In addition, a fuel pump 40 for feeding fuel in the fuel tank 19 to the throttle body 8 is attached under the fuel tank 19 and in the substantial center in a vertical direction of the left center frame 60L (see FIGS. 2 and 4). Further, a cover member 20 for holding fuel supply parts such as a fuel filter 11 and a regulator 14 respectively is provided between the fuel pump 40 and the throttle body 8 and is attached to the right center frame 60R under the fuel tank 19 (see FIGS. 2 and 3).

Figure 2:
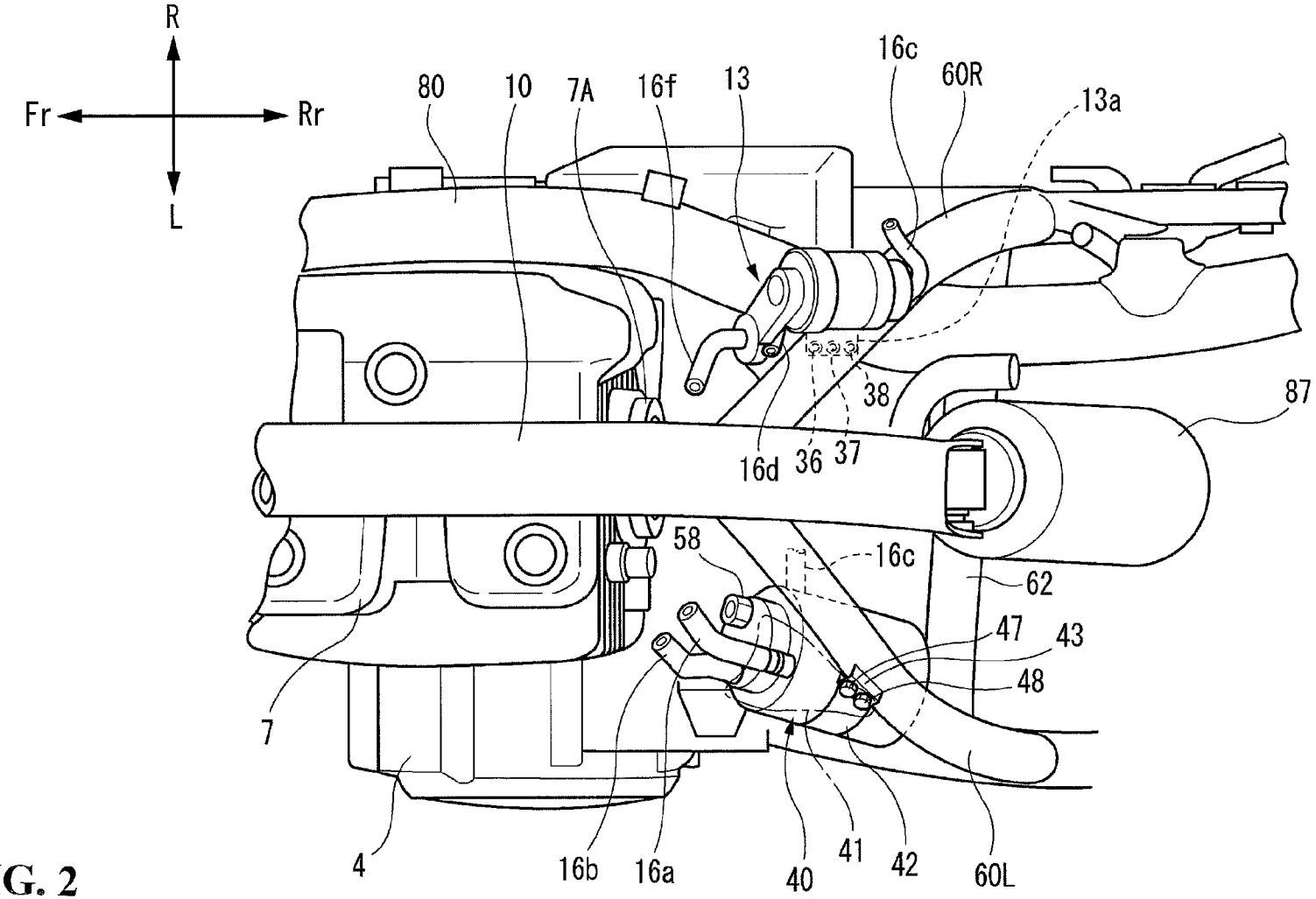
FIG. 2 is a schematic plan showing the motorcycle shown in FIG. 1 from which an upper pipe of a rear frame extended rearwardly in a vehicle body from a main frame is omitted when the motorcycle is viewed from the upside of a body frame.
Figure 3:
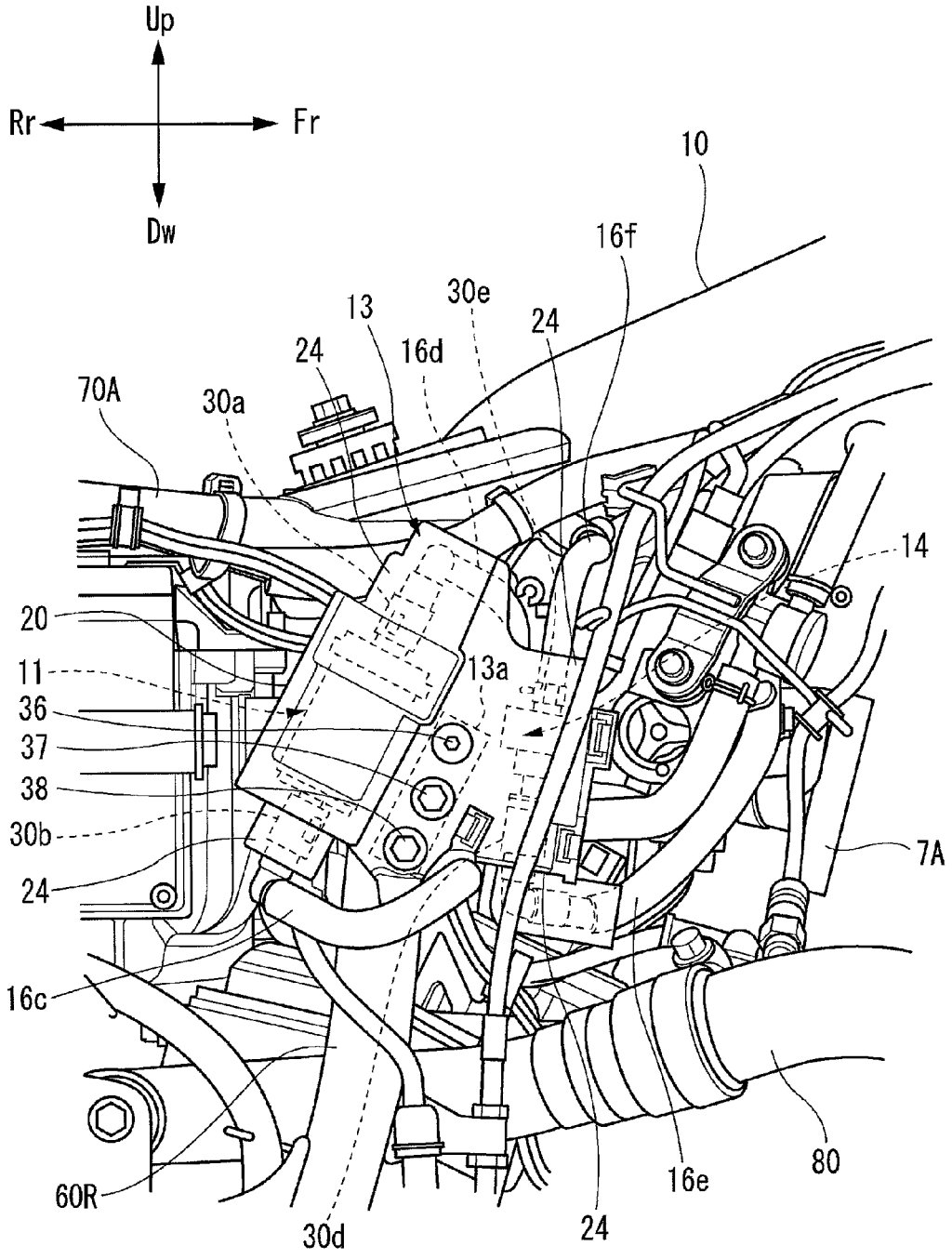
FIG. 3 is a schematic enlarged side view showing a main part viewed from the right side of the motorcycle shown in FIG. 1.
Figure 4:
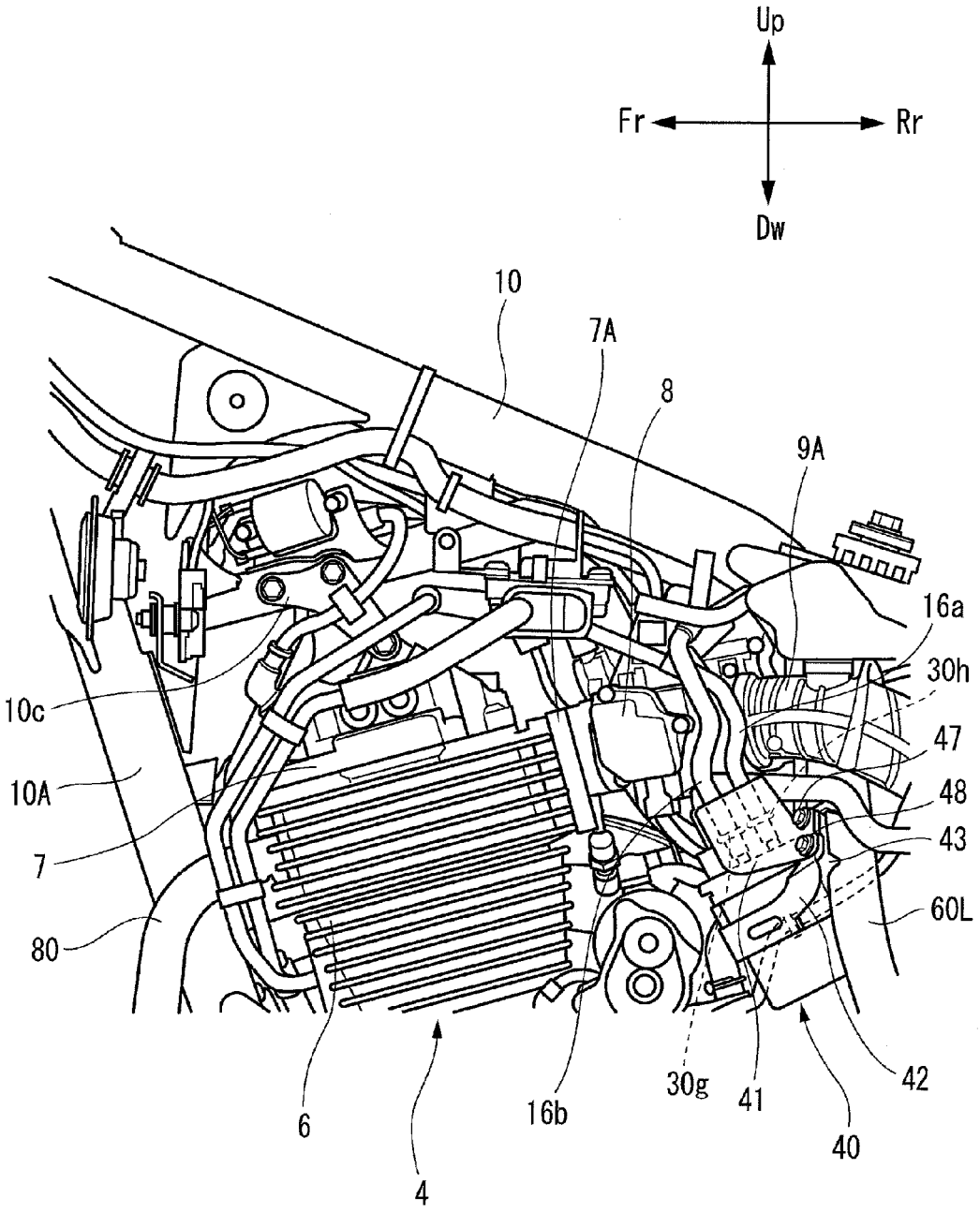
FIG. 4 is a schematic enlarged side view showing the main part viewed from the left side of the motorcycle shown in FIG. 1.
Figure 5:
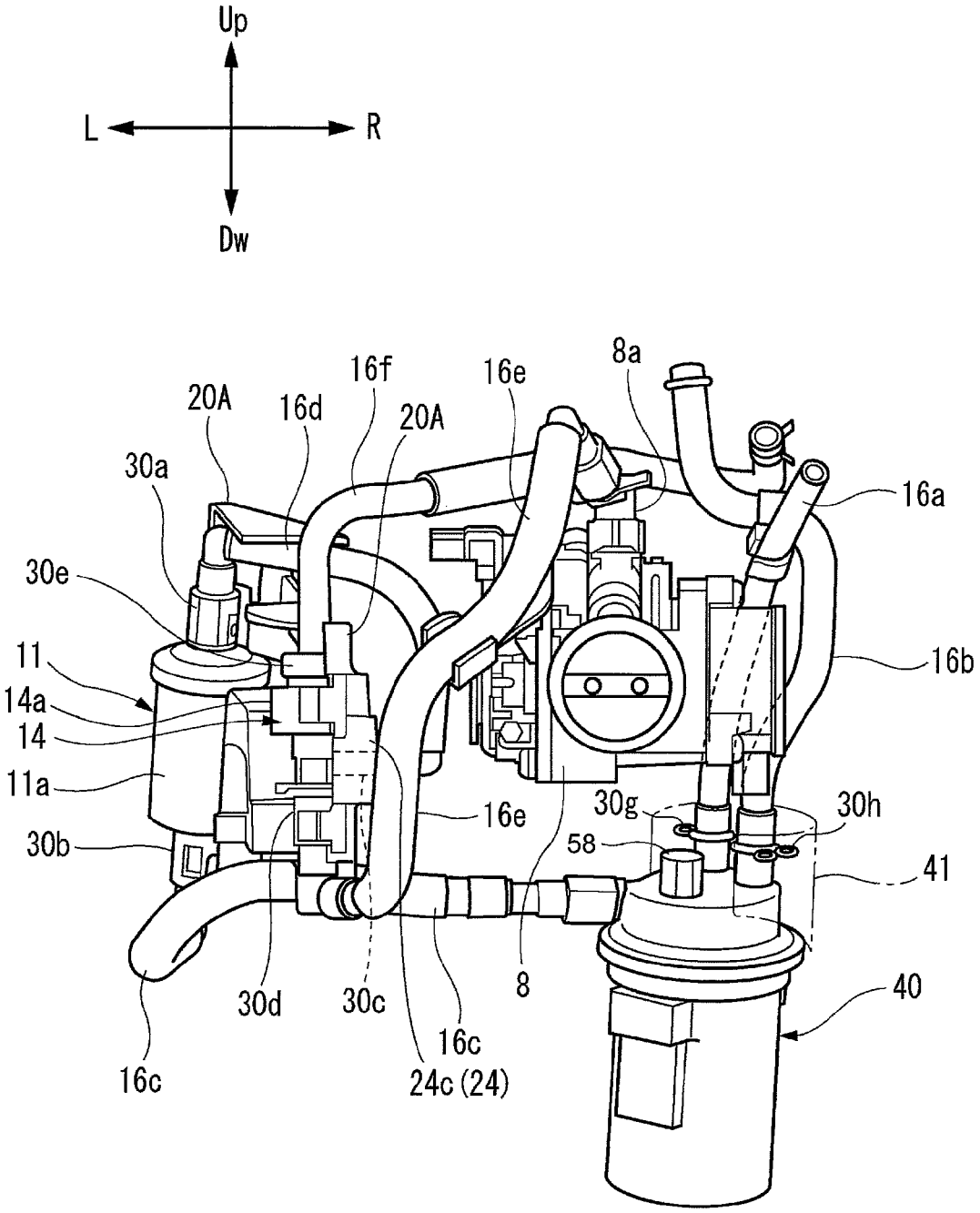
FIG. 5 is a schematic diagram showing a main part of the fuel supply parts for explaining a connected state of a fuel hose and an arranged state of the fuel supply parts in the motorcycle shown in FIG. 1.

FIG. 2 is a plan showing the motorcycle 1 shown in FIG. 1 from which the fuel tank 19 and the upper pipe 70A of the rear frame 70 extend rearward in the vehicle from the main frame 10 are omitted and which is viewed from the upside. In FIG. 2, a fuel hose 16 and its peripheral member are suitably omitted. FIG. 3 is a schematic enlarged view showing the vicinity of the center frame 60R when the motorcycle 1 shown in FIG. 1 is viewed from the right side and FIG. 4 is a schematic enlarged view showing the vicinity of the center frame 60L when the motorcycle 1 shown in FIG. 1 is viewed from the left side. FIG. 5 is a schematic diagram showing a main part in a state wherein the fuel supply parts are connected for explaining a passage of fuel in this embodiment As shown in FIG. 2, the rear of the main frame 10 extends in a longitudinal direction in the center in a direction of vehicle width and extends with the rear curved downwardly in the vehicle (see FIG. 1). In addition, the two center frames 60L, 60R branched laterally extend from a part curved downwardly. The center frames 60L, 60R extend downwardly and rearwardly and extend laterally in the vehicle body with shapes in the vicinity of each middle of which overhangs slightly in a forward direction. Lower ends of the center frames extend downwardly from the vicinities of the outsides of the vehicle body so that the lower ends are connected to the pair of right and left lower pipes 10B. An upper end of the rear shock absorber 87 is attached to the rear end of the main frame 10 extending rearwardly, compared with the center frames 60L, 60R and the rear shock absorber 87 is arranged in the substantial center of the vehicle body with the rear shock absorber tilted on the front side in the vehicle body.

As described above, as this embodiment has structure that the center frames 60L, 60R extending laterally in the vehicle from the curved part of the main frame 10 and extend downwardly in the vehicle body, a predetermined space can be secured on the upside and on the inside of the center frames 60L, 60R.

In this embodiment, the main frame 10 and the center frames 60L, 60R are cylindrically formed.

As shown in FIG. 2, the exhaust pipe 80 led from the exhaust port 7B of the cylinder head 7 extends in the longitudinal direction of the vehicle body on the right side of the main frame 10. Though it is omitted in FIG. 2, the throttle body 8 (see FIG. 4) is attached at the back of the intake port 7A of the cylinder head 7, and the fuel pump 40 and a filter unit 13 are arranged with the throttle body 8 held between them. More specifically, the filter unit 13 in which the fuel filter 11 and the regulator 14 are incorporated in the cover member 20 is attached to the right center frame 60R on the right side of the main frame 10 as shown in FIGS. 2 and 3.

The filter unit 13 is attached to a stay 13*a* provided to the center frame 60R via fastening screws 36, 37, 38. The filter unit 13 is slightly diagonally arranged so that its rear is located on the upside of the center frame 60R and its front is located inside the center frame 60R. More specifically, the filter unit 13 is arranged in a space formed on the upside and on the inside of the center frame 60R based upon the center frame 60R and is arranged close to the engine 4.

In the meantime, the fuel pump 40 is arranged on the left side of the main frame 10 as shown in FIGS. 1, 2 and 4. The fuel pump 40 is fixed to the middle part (the part overhanged on the outermost side in the vehicle body) of the center frame 60L via a stay 43 of the center frame 60L, a protective cover 41 and a bracket 42 by fastening screws 47, 48. The fuel pump 40 is attached in front of the center frame 60L, at the back of the cylinder block 6 and inside the center frame 60L. As described above, the fuel pump 40 is arranged close to the engine 4 utilizing the space formed by curving the center frame 60L with the center frame overhanged in the direction of the vehicle width.

The piping of the fuel supply parts in this embodiment will be described below.

The fuel pump 40, the fuel filter 11, the regulator 14 and a fuel injection valve 8*a* are connected via the flexible fuel hose 16 (in the drawing, individually shown as 16*a*, 16*b*, 16*c*, 16*d*, 16*e*, 16*f*) and fuel in the fuel tank 19 is supplied to the fuel injection valve 8*a*.

To further explain in detail with reference to FIG. 5, the fuel hose 16*a* extends to the fuel tank 19 located on the upside of the fuel pump 40 with the fuel hose 16*b* being provided on an upper end of the fuel pump 40. The fuel pump 40 sucks fuel from the fuel tank 19 via the fuel hose 16*a* and in the meantime, the fuel hose 16*b* (the breather tube) that suitably returns fuel from the fuel pump 40 to the fuel tank 19 is connected to the fuel pump. In addition, the fuel hose 16*c* extending laterally (to the left relative to the vehicle body) on the upside of the fuel pump 40 is connected to the side of a lower end of the fuel filter 11. The fuel hose 16*d* is connected to the side of an upper end of the fuel filter 11 and this fuel hose 16*d* is connected to the side of the regulator 14. The fuel hose 16*e* connected to the downside of the regulator 14 is connected to the fuel injection valve 8*a* provided to the throttle body 8 and the fuel hose 16*f* for returning excess fuel to the fuel tank 19 is connected to the regulator.

A connector 58 for an electric connection for driving the pump is provided to the upper end of the fuel pump 40.

In this embodiment, a fuel hose locking member 30 (30*a*, 30*b*, 30*c*, 30*e*, 30*g*, 30*h*) is provided to joints between the fuel filter 11/the regulator 14 and the fuel hose 16 for means for locking connected ends.

The description of the details of the fuel hose locking member 30 is omitted. However, the fuel hose locking member may be any type such as a so-called fitting type by pushing in the fitting/locking by pushing and a clip band type by tightening the periphery of the hose. The structure of the locking member is not particularly limited.

In addition, in this embodiment, as shown in FIGS. 3 and 4, as the fuel supply parts such as the fuel pump 40, the fuel filter 11 and the regulator 14 are located inside the center frames 60R, 60L or close to the inside of the center frames 60R, 60L, they are arranged close to the fuel tank 19 and the throttle body 8. As a result, they are connected by the fuel hose 16 (16*a*, 16*b*, 16*c*, 16*d*, 16*e*, 16*f*) of short length (distance). Accordingly, the fuel pump 40 can fulfill a function for sucking fuel from the fuel tank 19 and fully feeding the fuel.

Referring to FIGS. 6 to 9, the cover member 20 forming the filter unit 13 in this embodiment will be described below.

Figure 6:
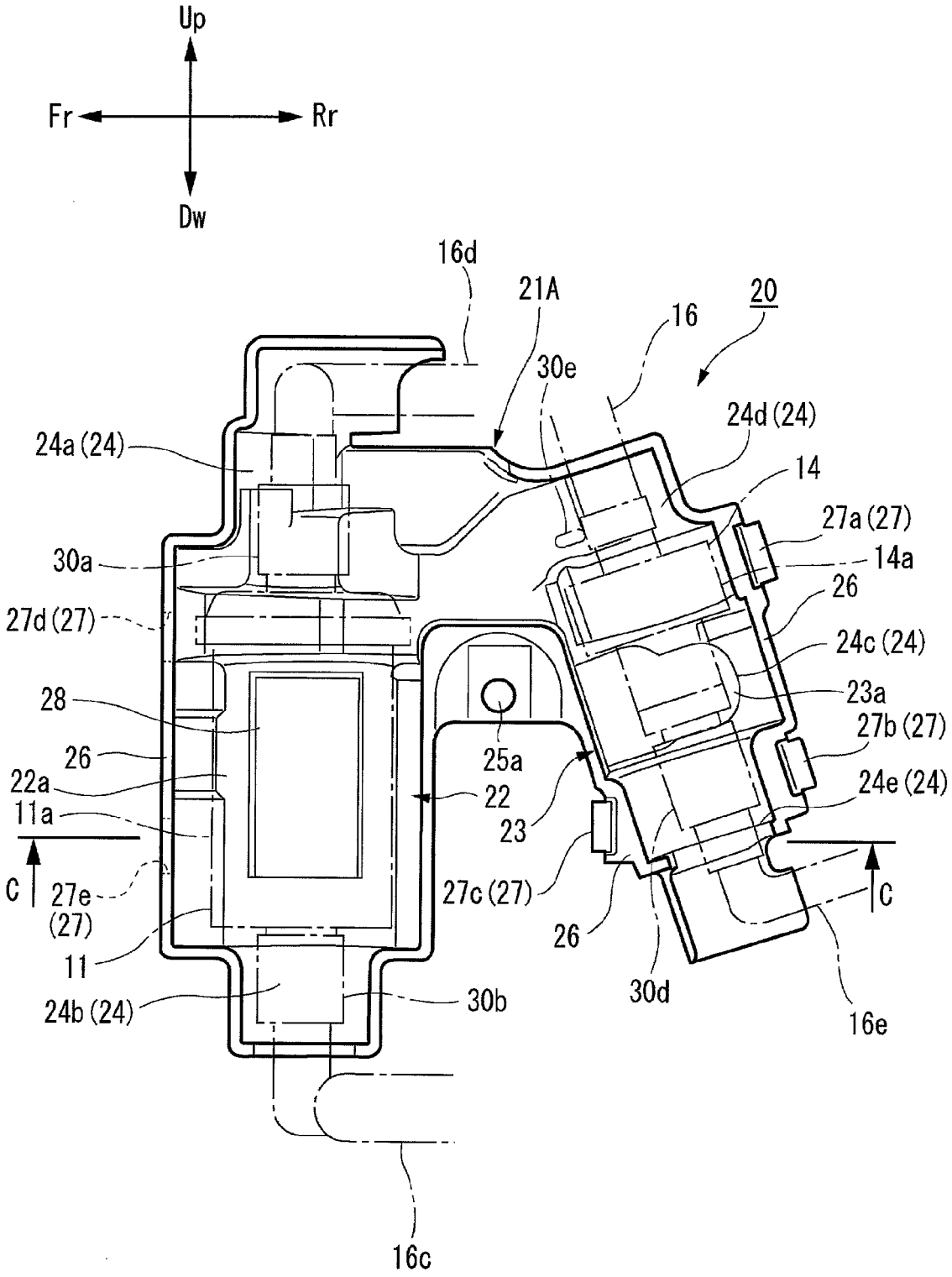
FIG. 6 is a plan showing a case of a cover member in one embodiment of the present invention.
Figure 7:
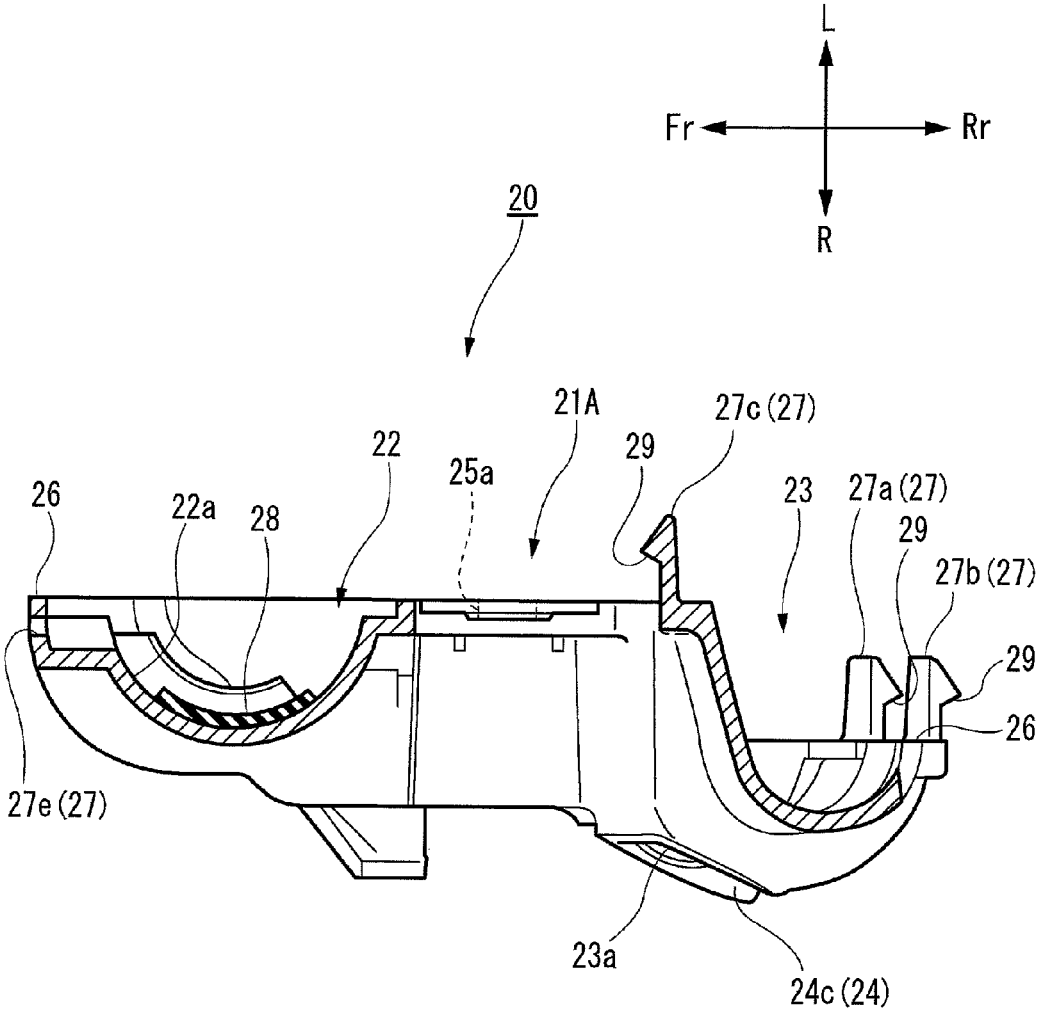
FIG. 7 is a sectional view showing a part viewed from an arrow direction along a line C-C in FIG. 6.
Figure 8:
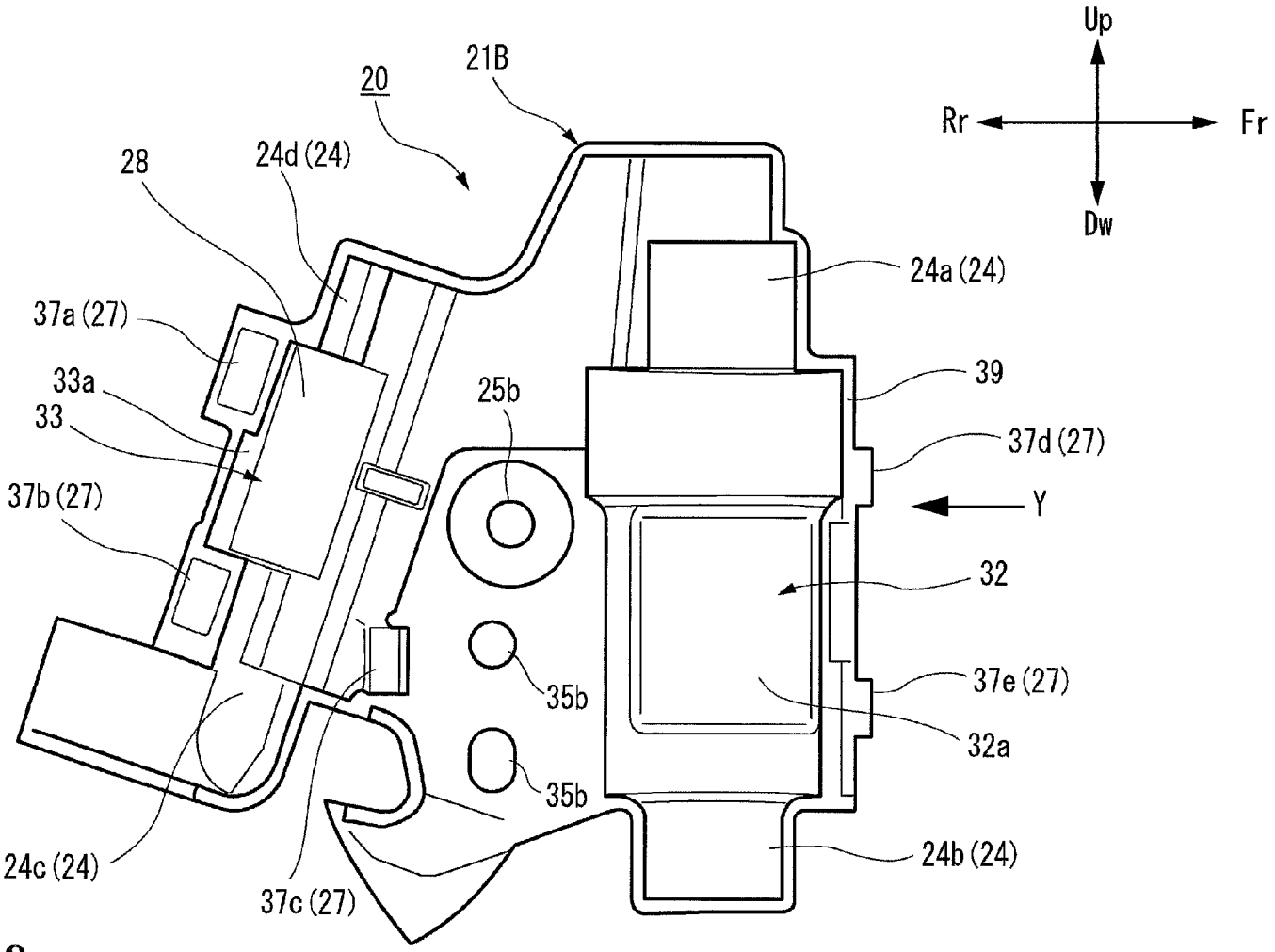
FIG. 8 is a plan showing a lid of the cover member in one embodiment of the present invention.
Figure 9:
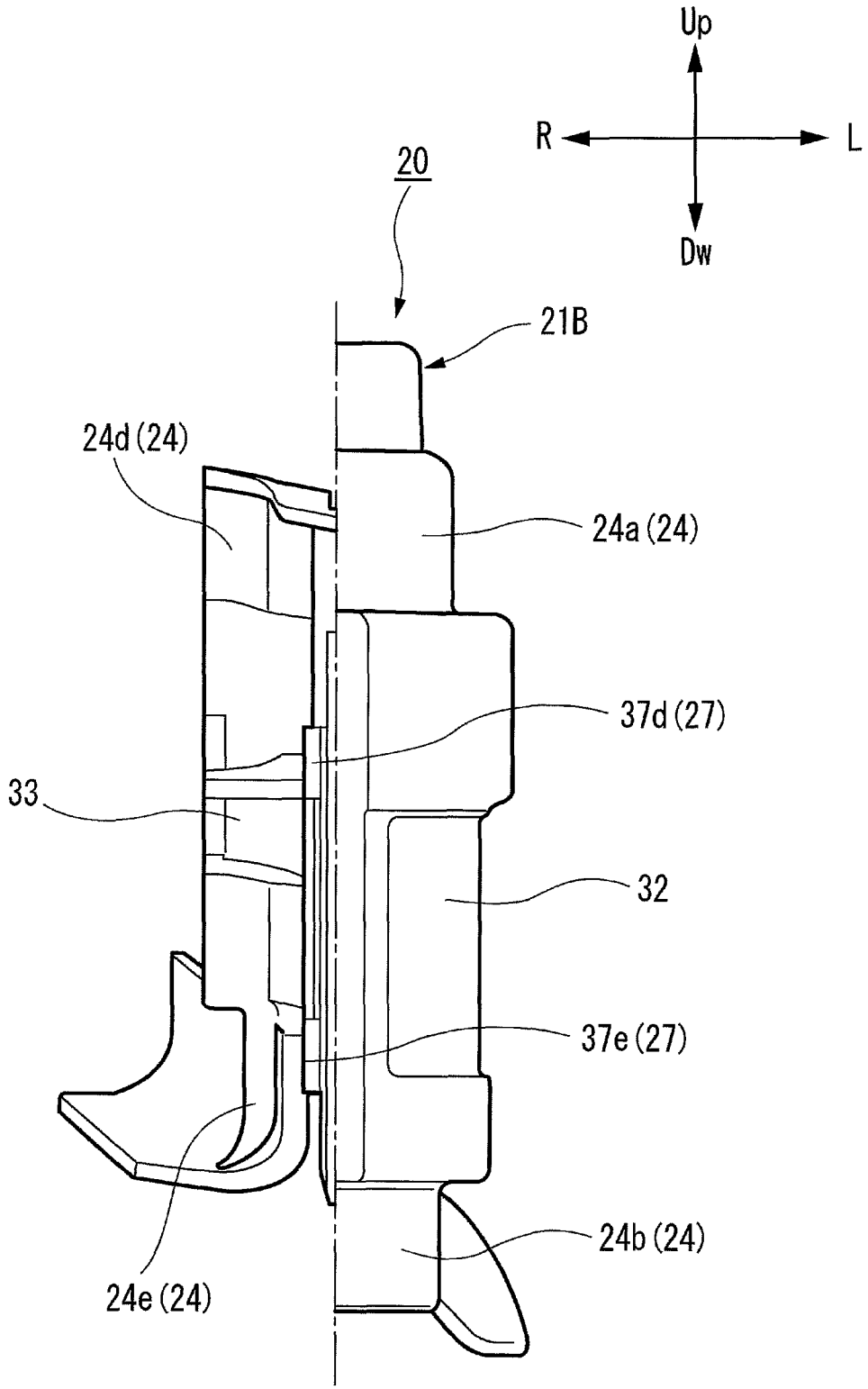
FIG. 9 is a side view viewed from a direction shown by an arrow Y in FIG. 8.

The cover member 20 in this embodiment has the assembly structure formed of a case 21A located close to the inside of the vehicle and a lid 21B located outside the vehicle. The case 21A is shown in FIGS. 6 and 7 and the lid 21B is shown in FIGS. 8 and 9.

The cover member 20 in this embodiment is configured so that the fuel filter 11 and the regulator 14 are integrally covered as described above and has a structure wherein the filter unit 13 can be formed. As the fuel filter 11 and the regulator 14 are fixed by the cover member 20, no individual fixing structure is required.

In addition, a cover 24 (in the drawing, individually shown by reference signs 24*a*, 24*b*, 24*c*, 24*d*, 24*e*) that covers the fuel hose locking member 30 that are the joints between the fuel hose 16 (16*c*, 16*d*, 16*e*, 16*f*) and the fuel filter 11/the regulator 14 is provided to the cover member 20. In this embodiment, the cover 24 is provided to both the case 21A and the lid 21B which will be described later. However, the cover 24*c* is provided to only the case 21A.

The cover member 20 in this embodiment is configured by the assembly of the case 21A and the lid 21B.

Referring to FIG. 6 and FIG. 7 which is a view viewed from an arrow direction along line C-C in FIG. 6, the case 21A of the cover member 20 will be described below.

As shown in FIG. 6, the case 21A houses the fuel filter 11 in a fuel filter housing 22 on the left side in the drawing and a regulator housing 23 that houses the regulator 14 is provided along an axis tilted by a predetermined angle with the axis of the fuel filter housing 22 on the right side in the drawing. Accordingly, the fuel filter housing 22 has a shape that can house the substantially cylindrical fuel filter 11 and the fuel hose locking member 30 (30*a* and 30*b*) provided to both upper and lower ends of the fuel filter 11 and is in the shape of a substantial semi-cylinder both upper and lower sides in FIG. 6 that are formed in a slightly minor diameter that is stepped.

In addition, the regulator housing 23 has a shape that can house the substantially cylindrical regulator 14 smaller than the fuel filter 11 and the fuel hose locking member 30 (30*c* and 30*d*) provided to both upper and lower ends of the regulator 14 and is in the shape of a substantial semi-cylinder that is provided with an opening 23*a* to the side of the regulator housing 23, both upper and lower sides of which are formed in a slightly minor diameter that is stepped.

The fuel hose locking member 30 (30*a* and 30*b*) of the fuel filter 11 is covered with the covers 24*a*, 24*b*. The fuel hose locking member 30 (30*c*, 30*d* and 30*e*) of the regulator 14 is covered with the covers 24*c*, 24*d*, 24*e* (as for the cover 24*c*, see FIG. 5).

As described above, the case 21A in this embodiment has recessed portions (made by the fuel filter housing 22, the regulator housing 23 and the cover 24) corresponding to an exterior shape of the fuel filter 11 and the regulator 14.

In this embodiment, a plurality of fitting parts 27 (individually shown as reference signs 27*a*, 27*b*, 27*c*, 27*d*, 27*e* in FIG. 6) for fitting to the lid 21B when the case is combined with the lid 21B described later are provided to the case 21A in fitting part peripheral edges 26 and their vicinities. Out of these fitting parts 27, fitting pawls 27*a*, 27*b*, 27*c* for fitting to fitting holes 37*a*, 37*b*, 37*c* (see FIG. 8) which are the fitting parts 27 of the lid 21B have a shape the end side of which is slightly got pointed and which is provided with a step 29 for hooking as shown in FIG. 7. In addition, fitting holes 27*d*, 27*e* into which fitting pawls 37*d*, 37*e* of the lid 21B are fitted are formed as a through hole (see FIG. 7) immediately under the fitting part peripheral edges 26.

Further, in this embodiment, a cushion member 28 having a predetermined thickness is provided to a filter barrel opposite part 22*a* opposite to a barrel 11*a* of the fuel filter 11 in suitable area in the fuel filter housing 22.

Referring to FIG. 8 and FIG. 9 viewed from a direction shown by an arrow Y in FIG. 8, the lid 21B of the cover member 20 will be described below.

In this embodiment, the lid 21B shown in FIG. 8 houses the fuel filter 11 in a fuel filter housing 32 on the right side in the drawing so that the filter barrel corresponds to a filter barrel opposite part 32*a* and on the left side in the drawing. In addition, a regulator housing 33 is provided that houses the regulator 14. The fuel filter housing 32 has a shape that can house the substantially cylindrical fuel filter 11 and the hose locking member 30 (30*a*, 30*b*) provided to both upper and lower ends of the fuel filter 11 like the case 21A described above and is in the shape of a substantial semi-cylinder both upper and lower sides in FIG. 8 of which are formed in a slightly minor diameter and which is stepped. The regulator housing 33 also has a shape that can house the regulator 14 and the fuel hose locking member 30 (30*c* and 30*d*) provided to both upper and lower ends of the regulator 14 and is also in the shape of a substantial semi-cylinder both upper and lower sides in FIG. 8 of which are formed in a slightly minor diameter and which is stepped.

As described above, according to the lid 21B in this embodiment, the outside in the vehicle body of the fuel hose locking member 30 is covered with a cover 24 (shown as reference signs 24*a*, 24*b*, 24*d*, 24*e* also in FIG. 8 like FIG. 6) provided to the lid 21B.

As described above, the lid 21B in this embodiment is provided with recessed portions (made by the fuel filter housing 22, the regulator housing 23 and the cover 24) corresponding to the exterior shape of the fuel filter 11 and the regulator 14 opposite to the case 21A.

In FIG. 8, for the reference signs of the covers 24*a*, 24*b*, 24*d*, 24*e*, the same reference signs are allocated to parts opposite to the case 21A shown in FIG. 6.

In the lid 21B in this embodiment, a plurality of fitting parts 27 (individually shown as the reference signs 37*a*, 37*b*, 37*c*, 37*d*, 37*e* in FIG. 8) for fitting to the case 21A when the lid is combined with the case 21A described above are provided to fitting part peripheral edges 39 and their vicinities. Out of these fitting parts 27, the fitting pawls 27*a*, 27*b*, 27*c* (see FIG. 6) of the case 21A are fitted into the fitting holes 37*a*, 37*b*, 37*c* and the fitting pawls 37*d*, 37*e* are fitted into the fitting holes 27*d*, 27*e* (see FIG. 6) of the case 21A.

Further, in this embodiment, a cushion member 28 having a predetermined thickness is provided to a regulator barrel opposite part 33*a* opposite to a barrel 14*a* of the regulator 14 in the regulator housing 33 in a suitable area.

The fuel filter 11 and the regulator 14 are suitably pressed by the elastic force of the cushion member 28 described above by combining the lid 21B and the case 21A respectively configured as described above in a state wherein the fuel filter 11 and the regulator 14 are housed and fitting the fitting parts and are securely held in the cover member 20 without rattling. In addition, the vibration of the vehicle body to the fuel filter 11 and the regulator 14 can be also buffered by the elastic force of the cushion member 28.

After the cover member 20 is assembled as described above, the cover member 20 is attached to the right center frame 60R as shown in FIG. 3. The cover member 20 is attached by the fastening screw 36 inserted to mounting holes 25*a*, 25*b* of both the case 21A and the lid 21B and the fastening screws 37, 38 inserted to two mounting holes 35*b* of the lid 21B. That is, the fastening screw 36 fastens both the case 21A and the lid 21B and the fastening screws 37, 38 fasten only the lid 21B.

According to the assembly of the cover member 20 in this embodiment, the fuel filter 11 and the regulator 14 are protected by the cover member 20 with the fuel filter 11 and the regulator 14 being enclosed by both right and left sides of the vehicle body and vertically as shown in FIG. 3. Accordingly, the fuel hose locking member 30 covered with the cover 24 is unseen from the outside or is made inoperable with fingers even if the fuel hose locking member is visible.

As described above, as the cover 24 of the cover member 20 covers the hose locking member 30, the fuel hose locking member 30 cannot be easily detached in the maintenance of the fuel supply parts or the part in the vicinity of the fuel supply parts for example. More specifically, an operation wherein the fuel hose locking member 30 is removed by mistake during work is avoided. Accordingly, a trouble such as the adhesion of fuel during maintenance work can be securely prevented.

In addition, in this embodiment, the cover member 20 can be detached from the vehicle body in a state wherein the cover member covers the fuel filter 11 and the regulator 14 and in a state wherein the fuel hose 16 is connected by removing the fastening screws 36, 37, 38. As described above, as the cover member 20 can be detached from the vehicle body in the state wherein the cover member covers the fuel filter 11 and the regulator 14 and the fuel hose 16 connected to the fuel filter 11 and the regulator 14 is made of flexible rubber or flexible synthetic resin, the fuel filter 11 and the regulator 14 can be suitably moved in the state wherein the fuel hose 16 is connected to them. Accordingly, the maintenance of the fuel supply parts or the peripheral part can be facilitated. In addition, as the fuel hose 16 is not removed, maintenance work can be made without contaminating its circumference by the adhesion of fuel.

Further, as for the fuel pump 40 in this embodiment, the fuel hose locking members 30*g*, 30*h* are covered with the protective cover 41 in a state wherein the fuel pump is attached as shown in FIG. 4. Accordingly, the removal of the fuel hose 16 by the wrong operation of the fuel hose locking members 30*g*, 30*h* can also be prevented by the protective cover 41.

In the above-mentioned embodiment, the cover member 20 integrally covers the fuel filter 11 and the regulator 14. However, the present invention is not limited to this case, the cover member may also cover only the fuel filter 11 or cover members that separately cover the fuel filter 11 and the regulator 14 may also be provided.

Further, in the above-mentioned embodiment, the thickness, a shape and an installation location of the cushion 28 provided inside the cover member 20 can be suitably set without particularly limiting.

In addition, the shape of the cover member 20 and the shape of the cover 24 in the present invention have only to be a shape in which the fuel hose locking member 30 is prevented from being removed and the shapes are not particularly limited. Further, the cover 24 in this embodiment is formed in both the case 21A and the lid 21B except 24*c*. However, the cover except 24*c* may also be provided to only the lid 21B outside the vehicle body.

Further, in the case of a motorcycle that has been described in the above-mentioned embodiment, however, the fuel supply structure of the saddle-ride type vehicle according to the present invention can be applied to other saddle-ride type vehicles including a three-wheeled vehicle and a four-wheeled vehicle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel supply structure for a saddle-ride vehicle wherein fuel supplied from a fuel tank to a fuel injection valve is supplied via fuel supply parts through a flexible fuel hose, comprising:

a cover member for covering the fuel supply parts;

a fuel filter housing formed within said cover member, said fuel filter housing having an upper end and a lower end with a substantially cylindrical space formed therebetween for accommodating a substantially cylindrical fuel filter;

an upper fuel hose locking member being provided adjacent to the upper end of the fuel filter housing;

a lower fuel hose locking member being provided adjacent to the lower end of the fuel filter housing;

said upper and lower fuel hose locking members being substantially semi-cylindrical with a diameter that is slightly reduced and stepped down relative to a diameter of the substantially cylindrical space in the fuel filter housing;

wherein the cover member is provided with a cover that covers the fuel hose locking members for locking a connection of the flexible fuel hose and each fuel supply part;

the fuel supply parts include the fuel filter and a regulator; and the fuel filter and the regulator being in close proximity to each other within a case with the cover member integrally covering the fuel filter and the regulator.

2. The fuel supply structure for the saddle-ride vehicle according to claim 1, wherein the cover member is freely attached/detached to/from a body frame in a state wherein the fuel hose locking member is covered.

3. The fuel supply structure for the saddle-ride vehicle according to claim 1, wherein the cover member has an assembly structure formed of the case and a lid; and the case and the lid, provided with recessed portions corresponding to an exterior shape of the fuel supply parts and a state wherein the fuel supply parts and the fuel hose locking member are covered, is maintained by the fitting of a plurality of fitting parts formed in both.

4. The fuel supply structure for the saddle-ride vehicle according to claim 2, wherein the cover member has an assembly structure formed of the case and a lid; and the case and the lid, provided with recessed portions corresponding to an exterior shape of the fuel supply parts and a state wherein the fuel supply parts and the fuel hose locking member are covered, is maintained by the fitting of a plurality of fitting parts formed in both.

5. The fuel supply structure for the saddle-ride vehicle according to claim 1, wherein an elastic cushion member abutting on the fuel filter is provided in the cover member.

6. The fuel supply structure for the saddle-ride vehicle according to claim 2, wherein an elastic cushion member abutting on the fuel filter is provided in the cover member.

7. The fuel supply structure for the saddle-ride vehicle according to claim 3, wherein an elastic cushion member abutting on the fuel filter is provided in the cover member.

8. A fuel supply structure for a saddle-ride vehicle comprising:

a fuel tank for supplying fuel;

a fuel injection valve;

fuel supply parts and a flexible fuel hose providing communication for a supply of fuel from the fuel tank to the fuel injection valve;

a cover member for covering the fuel supply parts;

a fuel filter housing formed within said cover member, said fuel filter housing having an upper end and a lower end with a substantially cylindrical space formed therebetween for accommodating a substantially cylindrical fuel filter;

an upper fuel hose locking member being provided adjacent to the upper end of the fuel filter housing;

a lower fuel hose locking member being provided adjacent to the lower end of the fuel filter housing;

said upper and lower fuel hose locking members being substantially semi-cylindrical with a diameter that is slightly reduced and stepped down relative to a diameter of the substantially cylindrical space in the fuel filter housing;

said fuel hose locking members locking a connection of the flexible fuel hose and each fuel supply part;

said cover member being provided with a separate cover portion for covering the fuel hose locking members and each fuel supply part;

the fuel supply parts include the fuel filter and a regulator; and the fuel filter and the regulator being in close proximity to each other within a case with the cover member integrally covering the fuel filter and the regulator.

9. The fuel supply structure for the saddle-ride vehicle according to claim 8, wherein the cover member is freely attached/detached to/from a body frame in a state wherein the fuel hose locking member is covered.

10. The fuel supply structure for the saddle-ride vehicle according to claim 8, wherein the cover member includes an assembly structure formed of the case and a lid; and the case and the lid, provided with recessed portions corresponding to an exterior shape of the fuel supply parts and a state wherein the fuel supply parts and the fuel hose locking member are covered, is maintained by the fitting of a plurality of fitting parts formed in both.

11. The fuel supply structure for the saddle-ride vehicle according to claim 9, wherein the cover member has an assembly structure formed of the case and a lid; and the case and the lid, provided with recessed portions corresponding to an exterior shape of the fuel supply parts and a state wherein the fuel supply parts and the fuel hose locking member are covered, is maintained by the fitting of a plurality of fitting parts formed in both.

12. The fuel supply structure for the saddle-ride vehicle according to claim 8, wherein an elastic cushion member abutting on the fuel filter is provided in the cover member.

13. The fuel supply structure for the saddle-ride vehicle according to claim 9, wherein an elastic cushion member abutting on the fuel filter is provided in the cover member.

14. The fuel supply structure for the saddle-ride vehicle according to claim 10, wherein an elastic cushion member abutting on the fuel filter is provided in the cover member.

* * * * *